United States Patent [19]

Suzuki et al.

[11] Patent Number: 4,682,936

[45] Date of Patent: Jul. 28, 1987

[54] FUEL SUPPLYING PUMP

[75] Inventors: Ryozo Suzuki; Jun Shiraga; Shingo Iwai; Tetuo Okashiro, all of Fukuyama, Japan

[73] Assignee: Mitsubishi Denki Kabushiki Kaisha, Tokyo, Japan

[21] Appl. No.: 823,098

[22] Filed: Jan. 27, 1986

[30] Foreign Application Priority Data

Jan. 29, 1985 [JP] Japan ..... 60-17096

[51] Int. Cl.[4] ..... F04B 21/08

[52] U.S. Cl. ..... 417/366; 417/424

[58] Field of Search ..... 417/366, 424; 418/47

[56] References Cited

U.S. PATENT DOCUMENTS 4,209,284 6/1980 Lochmann et al. ..... 417/366
4,370,102 1/1983 Sasaki et al. ..... 417/366 X

FOREIGN PATENT DOCUMENTS 963728 3/1975 Canada ..... 417/366
2637979 3/1978 Fed. Rep. of Germany ..... 417/366

*Primary Examiner*—Leonard E. Smith
*Assistant Examiner*—T. Olds
*Attorney, Agent, or Firm*—Lowe Price Leblanc Becker & Shur

[57] ABSTRACT

A suction port 22*a* of an end cover 22 and a suction port 21*a* of a pump casing 21 are disposed to have a certain angular distance from each other, and the end cover 22 is covered by fuel filtration element 23 with a gap against the bottom of the end cover 22, thereby resistance to fire flame ignited by collector of a pump motor becomes large and dangerous spreading of fire flame is prevented.

3 Claims, 5 Drawing Figures

FUEL SUPPLYING PUMP

FIELD OF THE INVENTION AND RELATED ART

1. Field of the Invention

The present invention generally relates to a fuel supplying pump and more particularly pertains to an improvement in electric fuel supplying pump which is operated in a condition of being placed at the bottom of a fuel tank of motor-car and so on, for instance, an electric motor type fuel pump having a commutator motor as a driving member.

2. Description of the Related Art

FIG. 4 is a cross sectional view which shows a conventional fuel supplying pump disclosed in Japanese published unexamined utility model application No. 52-55555. As shown in FIG. 4, the conventional fuel supplying pump consists of a motor part A, a pump part B and a fuel filtration device C. The motor part A comprises an armature 1, a permanent magnet 2, a collector part which includes a commutator 3 and brushes 4, a shaft 5, a thrust bearing 6 which supports an end part of the shaft 5, a motor casing 7 which contains the above-mentioned elements, and a bracket 8 which closes a lower opening of the motor casing 7 and supports another end part of shaft 5 and further functions as a part of the below-mentioned pump casing 11. Next the pump part B comprises a suction port 9, an output port 10, a pump casing 11 and an impeller 12 which is fixed to the shaft 5 to constitute a peripheral type pump. The fuel filtration device C is connected with the above-mentioned suction port 9. Thus, the conventional fuel supplying pump is constructed as a combination of the above-mentioned motor part A, pump part B and fuel filtration device C.

In the above-mentioned conventional fuel supplying pump, the peripheral type pump is coupled to a DC commutator motor so that the former is driven by the latter, and fuel is sucked into a pump chamber of the pump part B through the fuel filter and is pressurized and output through an output port.

Installation of the fuel supplying pump having the above-mentioned construction in a fuel tank is made as shown in FIG. 5, wherein the fuel supplying pump P shown in FIG. 4 is held with a metal band a with a shock absorbing material, for instance rubber, therebetween, in a manner of being suspended by a supporting strip s from an inside face of a lid c disposed on top face $T_1$ of the fuel tank T. A power source connection terminal d and a connecting tube e, which is for connection of a fuel feeding hose connected to the fuel supplying pump P, are provided on the lid 4. An output port $P_1$ of the fuel supplying pump P and the connecting tube e are each other connected by rubber hose, and further, at the midway of said rubber hose e a relief valve y is provided as a pressure control device. Said power source connection terminal d is connected with a power source terminal of the fuel supplying pump P by conductor h. The pump P is installed at a position close to the bottom face $T_2$ of the fuel tank, controlling length of the supporting plate b and the rubber hose f.

When the above-mentioned conventional fuel supplying pump is sunk under surface level of the fuel, for instance gasoline, there is no problem. But, in case that the fuel surface level lowers and the collector part becomes exposed to vaporized fuel in the tank, a possibility of a dangerous explosion arises because the fuel (gasoline) vapor is highly flammable and a spark from brush 4 easily ignites the fuel vapor.

In case when the fuel vapor is ignited in the collector, a flame in this motor part reaches the pump chamber, and further the flame reaches fuel filtration element c through a suction port 9. Moreover, the fire is ready to reach the fuel tank T. Usually, when the flame passes through the net part, the flame is dispersed by the net of the fuel filtration element c, and combustion temperature is lowered by decrease of ignition energy, thereby preventing spreading of fire to the fuel tank T to some extent. However in case that fuel filtration element c, which is constructed of nylon net or the like organic substance, is damaged to make a hole, or disconnection of the fuel filtration element c and suction port 9 takes place, there is a great possibility of dangerous spreading of fire to the fuel tank T.

OBJECT AND SUMMARY OF THE INVENTION

The present invention is intended to solve the above-mentioned problems of the prior art, and the purpose of the present invention is to obtain a safe fuel supplying pump having a simple construction.

The fuel supplying pump of the present invention to be disposed at the bottom of a fuel tank and driven by electric driving means, comprises a pump casing having a suction port, an end cover having a suction port, and a fuel filtration element disposed under the end cover with a gap between the end cover and fuel filtration element, the suction port of the end cover and the suction port of the pump, said suction port of said end cover and said suction port of said pump casing being disposed to have angular distance and circumferential spacing from each other.

In the present invention, even if fuel vapor catches fire, energy of the fire is greatly decreased because of intercepting effect of the end cover and a detour made by different positions of suction ports of the pump case and end cover. As a result, spreading of fire to fuel tank is certainly prevented.

DESCRIPTION OF THE PREFERRED EMBODIMENT

Figure 1:
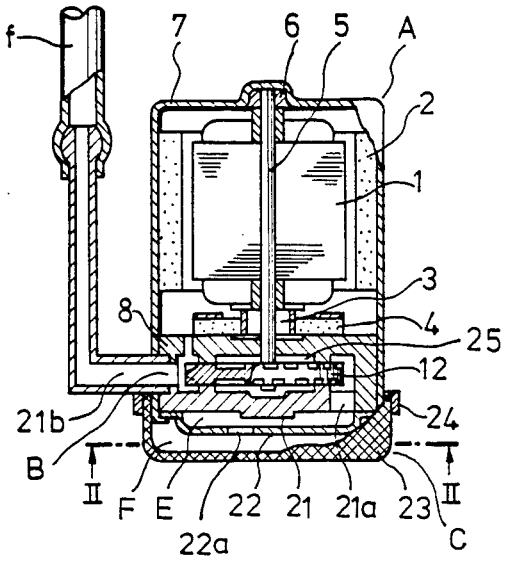
FIG. 1 is a sectional view showing a fuel supplying pump as an embodiment of the present invention.
Figure 2:
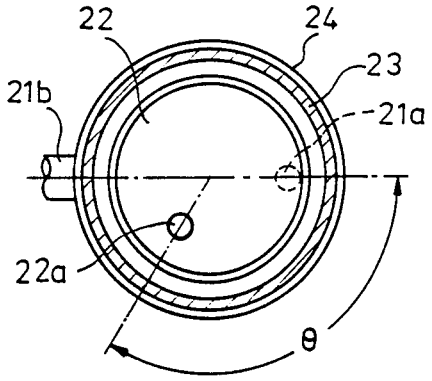
FIG. 2 is a partly sectional view taken on line II—II of FIG. 2.

In the following, an embodiment in accordance with the present invention is explained with reference to FIGS. 1, 2 and 3. As shown in FIG. 1, the fuel supplying pump embodying the present invention consists of a motor part A, a pump part B and a fuel filtration part C. The motor part A consists of a DC commutator motor which comprises an armature 1, a permanent magnet 2, a collector part which includes commutator 3 and brushes 4, a shaft 5, a thrust bearing 6 which supports an end part of the shaft 5, a motor casing 7 which contains the above-mentioned elements, and a bracket 8 which closes a lower opening of the motor case 7. A peripheral type pump is coupled to a DC commutator motor so that the former is driven by the latter, and fuel is sucked into a pump chamber 25 of the pump part B through the fuel filter and is pressurized and output through an output port.

Figure 3:
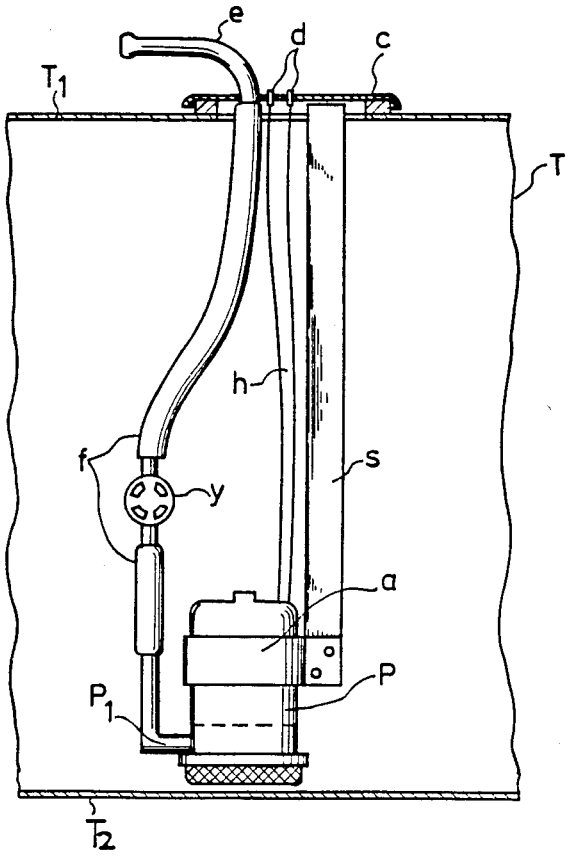
FIG. 3 is structural drawing showing a state that conventional fuel supplying pump is installed in the fuel tank.
Figure 4:
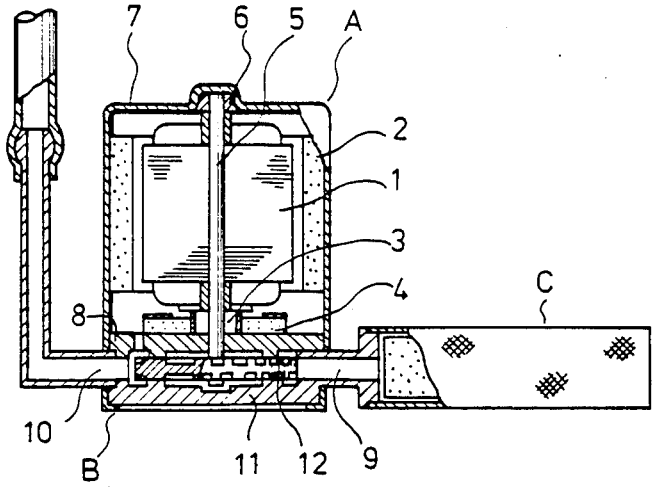
FIG. 4 (Prior Art)
FIG. 4 is the sectional view showing the conventional fuel supplying pump.
Figure 5:
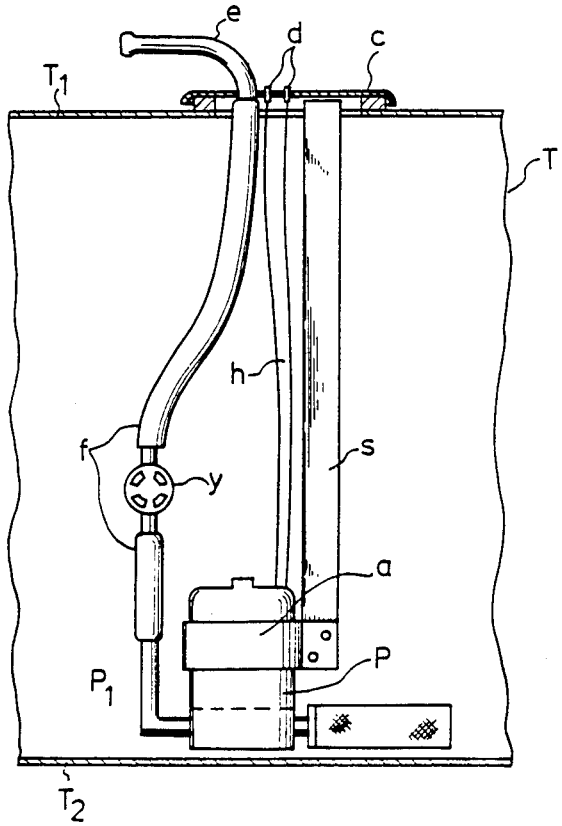
FIG. 5 (Prior Art)
FIG. 5 is the structural drawing showing the state that conventional fuel supplying pump is installed in the fuel tank.

Installation of the fuel supplying pump having the above-mentioned construction in a fuel tank is made as shown in FIG. 3, wherein the fuel supplying pump P shown in FIG. 3 is held with a metal band a with a shock absorbing material, for instance rubber, therebetween, in a manner of being suspended by a supporting strip s from an inside face of a lid c disposed on a top face $T_1$ of the fuel tank T. A power source connection terminal d and a connecting tube e, which is for connection of a fuel feeding hose connected to the fuel supplying pump P, are provided on the lid 4. An output port $P_1$ of the fuel suplying pump P and the connecting tube e are each other connected by rubber-hose, and further, at the midway of said rubber hose e a relief valve g is provided as a pressure control device. Said power source connection terminal d is connected with a power source terminal of the fuel supplying pump P by conductor h. The pump P is installed at a postion close to the bottom face $T_2$ of the fuel tank controlling length of the supporting strip s and the rubber hose f. A pump case 21 is provided with suction port 21*a* and an output port 21*b*. An end cover 22 put on the lower part of a pump case 21 is arranged, in a manner to make a fuel passage E between the pump case 21 and the end cover 22. As shown in FIG. 2, a suction port 22*a* is provided on the end cover 22 at such a position apart from the suction port 21*a* of a pump case 21 so as not to face the suction port 21*a*, that is, positions of two suction ports 21*a*, 22*a* are apart by degree each other. A fuel filtration element 23 is provided to cover the lower part of said end cover 22, and it is made of flexible or resilient synthetic fiber or soft and fine wires. The filtration element is mounted with its opening end part thereof on the outer circumference of the lower part of an end cover and is fixed by a band 24, keeping appropriate gap between the lower end of the end cover 22 and the filtration element 23. A rubber hose f is connected with the output port 21*b*.

Next, an operation of the above-mentioned embodiment of the fuel supplying pump of the present invention is described. As shown in FIGS. 1–3, in case that said fuel supplying pump is operated, being sunk under the fuel, the fuel is sucked through the filtration element 23, suction ports of the end cover 22 and pump casing 21. And further the fuel is pressurized, and supplied from the output port 21*b* to an internal combustion engine or the like through the rubber hose f.

In this case, since the pump casing 21 is covered with the pump cover 22 and furthermore the lower outside thereof is covered with the fuel filtration element 23, if the fuel vapor happens to catch fire at the collector, a spreading of fire to the fuel tank is prevented. Thus a safer fuel pump is obtained.

That is, in order to prevent the dangerous spreading of fire, the present invention adopts a gap anti-explosion construction. Therefore even when the fuel vapor happens to catch fire, each connecting part is formed uneven in their inside shape. And then, they are assembled, and further holes through which the fire flame passes are made as small as possible and a passage of fire flame is bent as far as possible to make the fire detour. Thereby the passage of fire is made long and narrow, and as a result, the fire flame is cooled and dispersed, and hence the energy of the fire decreases, and temperature of combustion is lowered, thus preventing the dangerous spreading of fire.

That is, when the fuel vapor happens to catch fire at the collector, the fire flame spreads from the motor part A to a pump chamber 25, and further it gets out of the pump chamber 25 through the suction port 21*a*, which is provided in the pump casing 21 and gaps formed between the bracket 8, pump case 21 and impeller 12. And then, the fire flame collides against the end cover 22 and is bent at right angle with the end cover 22, and spreads to fuel passage E, and further is going to reach the gap F through the suction port 22*a* of the end cover. However, while the fire flame spreads to the suction port 22, the energy of the fire is decreased by the collision against the end cover 22 and the passing through the narrow suction port 22*a*. Therefore, the fire energy becomes unable to get out of the suction port 22*a*. This was confirmed by explosive flush test in accordance with JIS-C0904 (Japanese Industrial Standard, test method on general industry electrical apparatus for explosive gas atmospheres), wherein hydrogen gas (explosive grade No. 1), which more easily catches fire than gasoline vapor (explosive grade No. 1), is forced to ignite inside the motor.

Furthermore, the explosion preventing ability is dependent on size of the suction port 22*a* of end cover 22 and relation of hole position between the suction port 21*a* of pump case 21 and the suction port 22*a* of end cover. Many explosive flush tests are made for various combinations of the size of holes of the suction ports 21*a*, 22*a* and the relation of hole position, in a fuel supplying pump which supplies fuel with an internal-combustion engine of a motor car as the embodiment of the present invention. As a result of the tests, because of liquid resistance, the size of suction port 22*a* cannot be made excessively small. For instance, when the size of suction port 22*a* is 4 mm in diameter, and their angular distance between the suction port 22*a* and the output suction port 21*a* is in a range of 120°–240°, an anti-explosion ability in hydrogen gas of explosive grade No. 1 has been confirmed. Moreover, in a smaller discharge fuel supplying pump than the above example, it is possible to make the size of suction port 22*a* less than 4 mm in diameter, and further to select the angular distance between the suction port 22*a* and output suction 21*a* smaller than 120°–240°, retaining the same anti-explosion ability.

As mentioned above, since the fuel supplying pump of the present invention comprises the end cover 22 having the hole, between the pump casing 21 and the fuel filtration element 23, even when fuel vapor happens to catch fire under the condition that the fuel filtratio element 23 is damaged to make a hole and fallen away from the motor casing, such as by putting out of the fixing band, dangerous sprading of fire flame is prevented. Therefore, according to the present invention, the fuel supplying pump which is of high safety and simple configuration is obtainable.

What is claimed is:

1. A fuel supplying pump, to be disposed within a fuel tank on a bottom thereof to be driven by electric driving means, comprising a pump casing having a center axis and a suction port, an end cover having a center axis and a suction port, and a fuel filtration element disposed under said end cover with a gap F between said end cover and said fuel filtration element, said suction port of said end cover and said suction port of said pump casing each being disposed on a radial line extending from said center axis at a position removed from said center axis, said radial lines being angularly separated.

2. A fuel supplying pump in accordance with claim 1, wherein said suction port of said pump is provided at a bottom of said pump casing, said end cover is provided at a bottom part of said pump casing below said pump casing.

3. A fuel supplying pump in accordance with claim 1, wherein said fuel filtration element comprises a net made of one of flexible and resilient synthetic fiber of soft and fine wire, and an upper opening part thereof is fastened to an outer circumference of motor casing.

* * * * *